US010494702B2

(12) United States Patent
Kim et al.

(10) Patent No.: US 10,494,702 B2
(45) Date of Patent: Dec. 3, 2019

(54) ALUMINUM CASTING ALLOYS HAVING MANGANESE, ZINC AND ZIRCONIUM

(71) Applicants: ALCOA INC., Pittsburgh, PA (US); GK CORPORATION, Ansan (KR)

(72) Inventors: Jinsoo Kim, Murrysville, PA (US); Jen C. Lin, Export, PA (US); Adam J. Schaut, Murrysville, PA (US); JongHoon Jeong, Siheung-si (KR); DongSung Shin, Siheung-si (KR)

(73) Assignees: ARCONIC INC., Pittsburgh, PA (US); GLTECH CO., LTD., Ansan (KR)

( * ) Notice: Subject to any disclaimer, the term of this patent is extended or adjusted under 35 U.S.C. 154(b) by 425 days.

(21) Appl. No.: 14/834,857

(22) Filed: Aug. 25, 2015

(65) Prior Publication Data

US 2016/0060732 A1 Mar. 3, 2016

Related U.S. Application Data

(60) Provisional application No. 62/042,638, filed on Aug. 27, 2014.

(51) Int. Cl.
*C22C 21/10* (2006.01)
*C22C 21/00* (2006.01)

(52) U.S. Cl.
CPC ..... *C22C 21/10* (2013.01); *C22C 21/00* (2013.01)

(58) Field of Classification Search
CPC ..... C22C 21/10
See application file for complete search history.

(56) References Cited

U.S. PATENT DOCUMENTS

| | | | | |
|---|---|---|---|---|
| 3,833,484 | A | 9/1974 | Yanagida et al. | 204/29 |
| 4,038,072 | A | 7/1977 | Kolobnev et al. | 75/142 |
| 4,334,935 | A * | 6/1982 | Morris | C22F 1/04 148/437 |
| 4,435,213 | A * | 3/1984 | Hildeman | B22F 3/105 148/567 |
| 5,415,709 | A | 5/1995 | Kita | 148/437 |
| 8,349,462 | B2 | 1/2013 | Lin et al. | 428/472.2 |
| 2001/0016175 | A1 | 8/2001 | Koch et al. | 420/542 |
| 2004/0261916 | A1 | 12/2004 | Lin et al. | 148/549 |
| 2005/0167012 | A1 | 8/2005 | Lin et al. | 148/549 |
| 2005/0238528 | A1 | 10/2005 | Lin et al. | 420/532 |
| 2006/0289093 | A1 | 12/2006 | Yan et al. | 148/549 |
| 2007/0017604 | A1 | 1/2007 | Yan et al. | 148/549 |
| 2007/0125460 | A1 | 6/2007 | Lin et al. | 148/440 |
| 2012/0000578 | A1 | 1/2012 | Wang et al. | 148/549 |
| 2012/0055588 | A1 * | 3/2012 | Kamat | C22C 21/10 148/551 |
| 2012/0261035 | A1 | 10/2012 | Lin et al. | 148/549 |
| 2013/0105045 | A1 | 5/2013 | Yan et al. | 148/95 |
| 2013/0156635 | A1 | 6/2013 | Lee et al. | 420/532 |
| 2015/0096893 | A1 | 4/2015 | Jeong et al. | |

FOREIGN PATENT DOCUMENTS

| | | | |
|---|---|---|---|
| JP | S50-16631 | | 2/1975 |
| JP | 2002-256364 | | 9/2002 |
| JP | 2004303459 | * | 10/2004 |
| JP | 2012149354 | * | 12/2013 |
| JP | 2014-077179 A | | 5/2014 |
| JP | 2014-114475 A | | 6/2014 |
| WO | WO2006/087823 | * | 8/2006 |
| WO | WO2013024732 | * | 2/2013 |

OTHER PUBLICATIONS

International Search Report and Written Opinion, dated Oct. 28, 2015, from corresponding International Patent Application No. PCT/US2015/046676.

Registration Record Series Pink Sheets, "Designations and Chemical Composition Limits for Aluminum Alloys in the Form of Castings and Ingot", The Aluminum Association, Arlington, Virginia, Nov. 2009, 20 pages.

* cited by examiner

*Primary Examiner* — Matthew E. Hoban
(74) *Attorney, Agent, or Firm* — Greenberg Traurig, LLP

(57) ABSTRACT

Improved aluminum casting alloys having are disclosed. The new aluminum casting alloys generally include manganese, zinc, and zirconium. In this regard, the new aluminum casting alloys generally include from 2.0 to 5.0 wt. % Mn, 1.0-4.5 wt. % Zn, and from 0.05 to 0.9 wt. % Zr, the balance being aluminum, optional secondary elements, iron and silicon impurities, and other elements, where the new aluminum casting alloy includes not greater than 0.15 wt. % each of the other elements, and where the new aluminum casting alloy included not greater than 0.50 wt. % in total of the other elements.

13 Claims, 4 Drawing Sheets

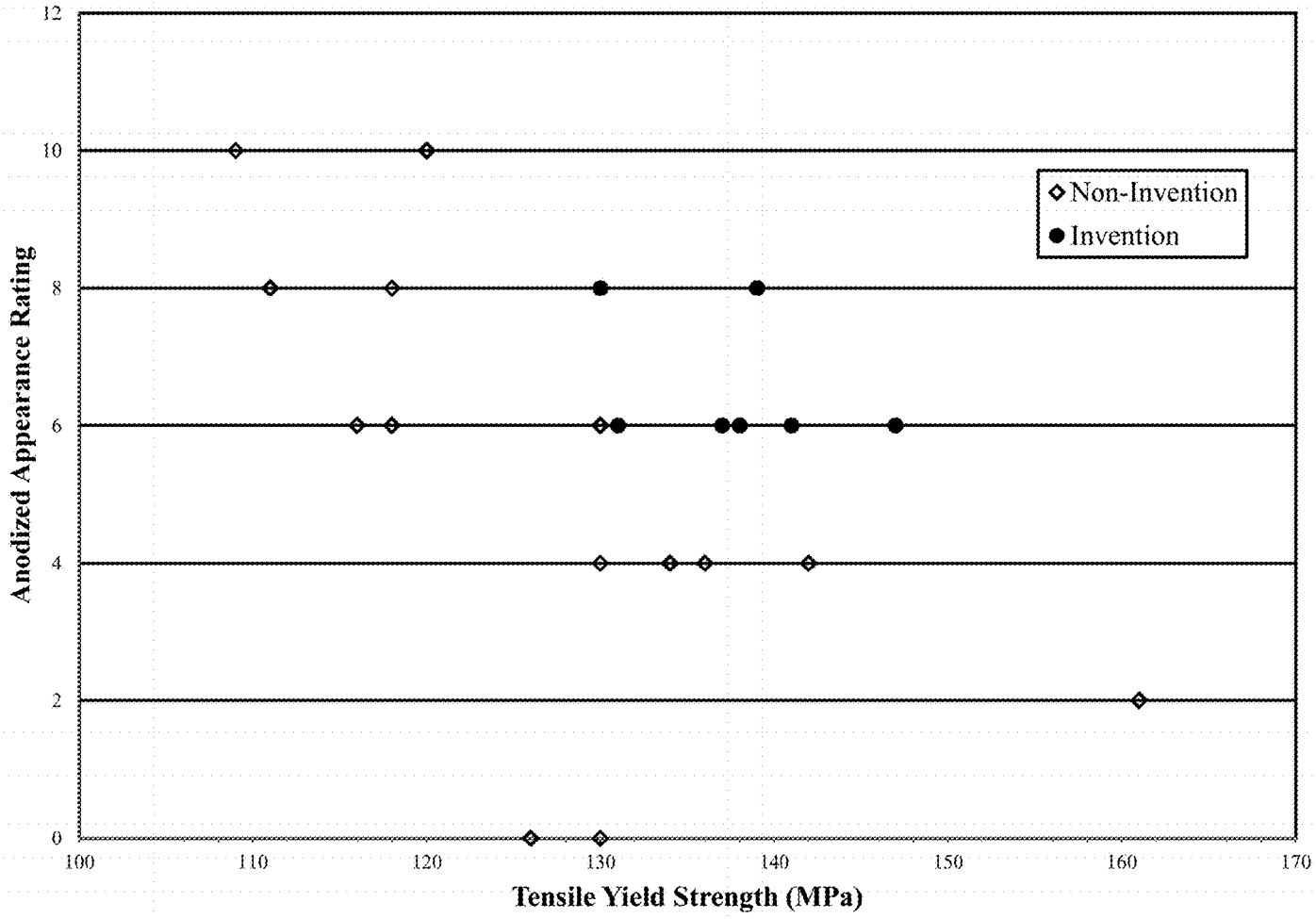
FIG. 1a - Tensile Yield Strength v. Anodized Appearance

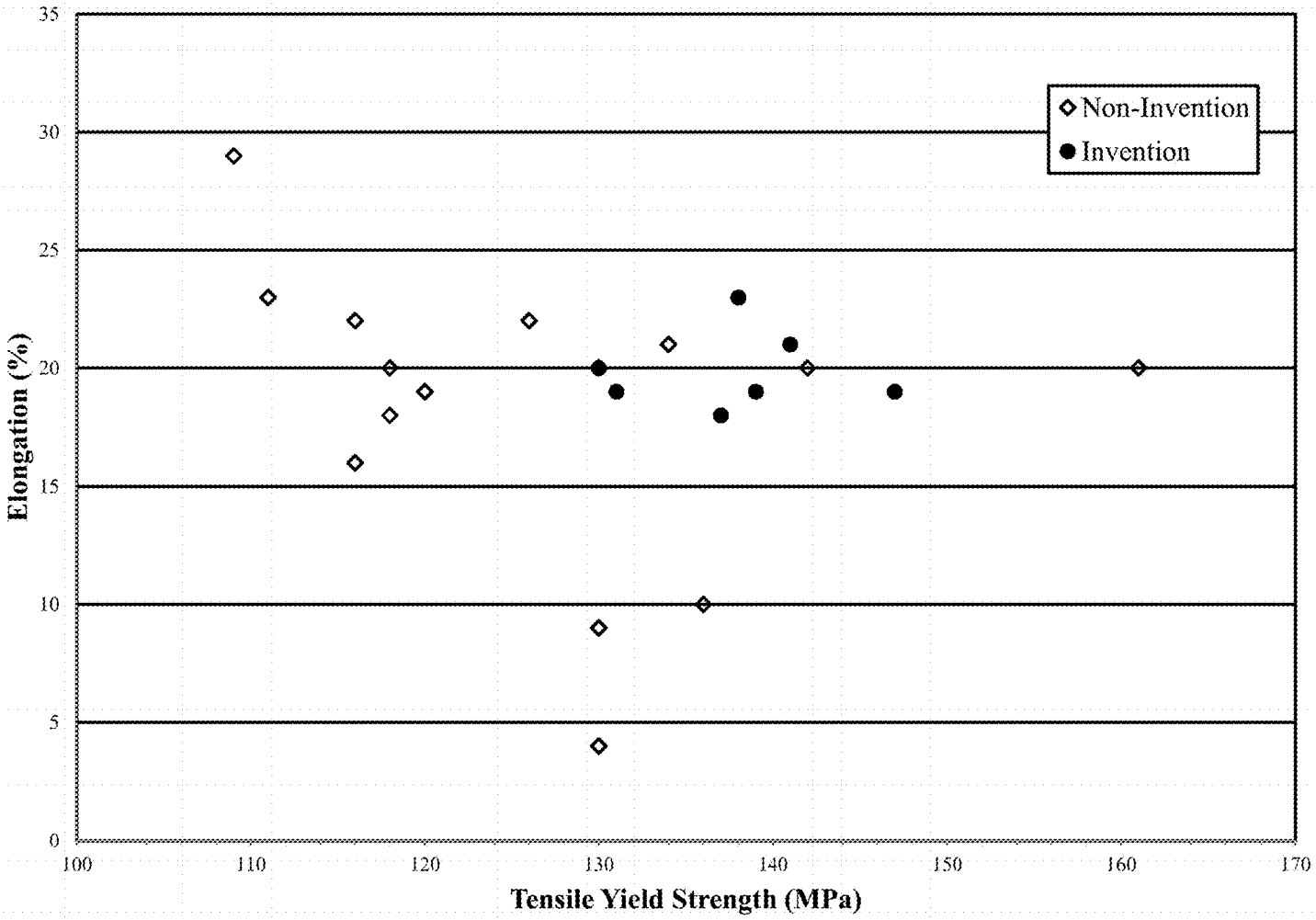
FIG. 1b - Tensile Yield Strength v. Elongation

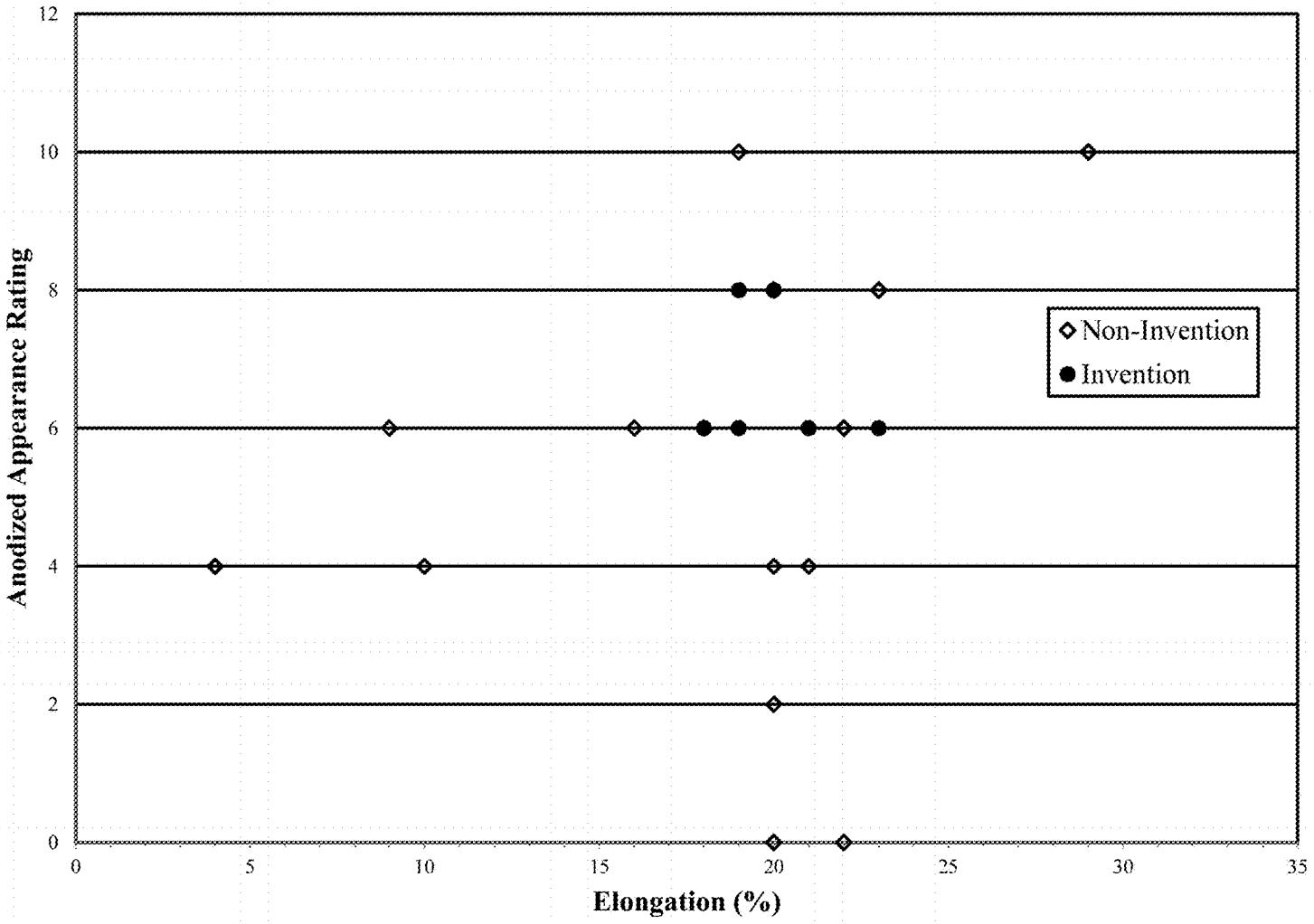
FIG. 1c - Elongation v. Anodized Appearance

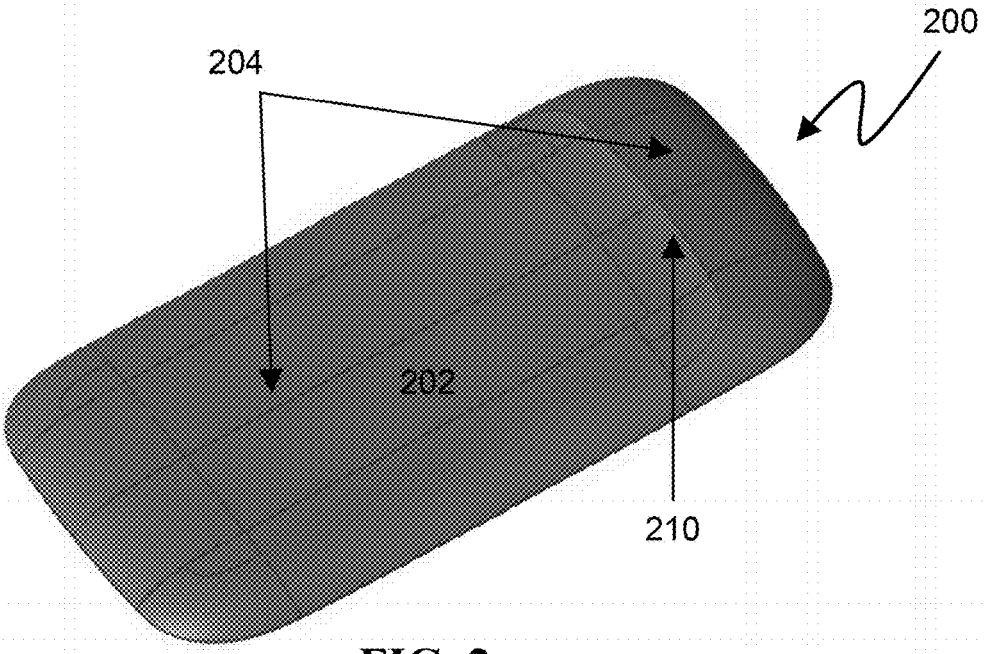
FIG. 2a
FIG. 2c
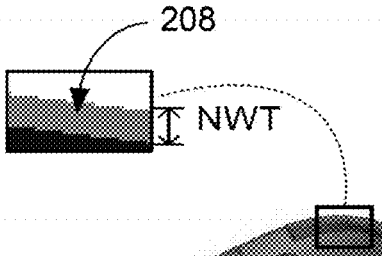
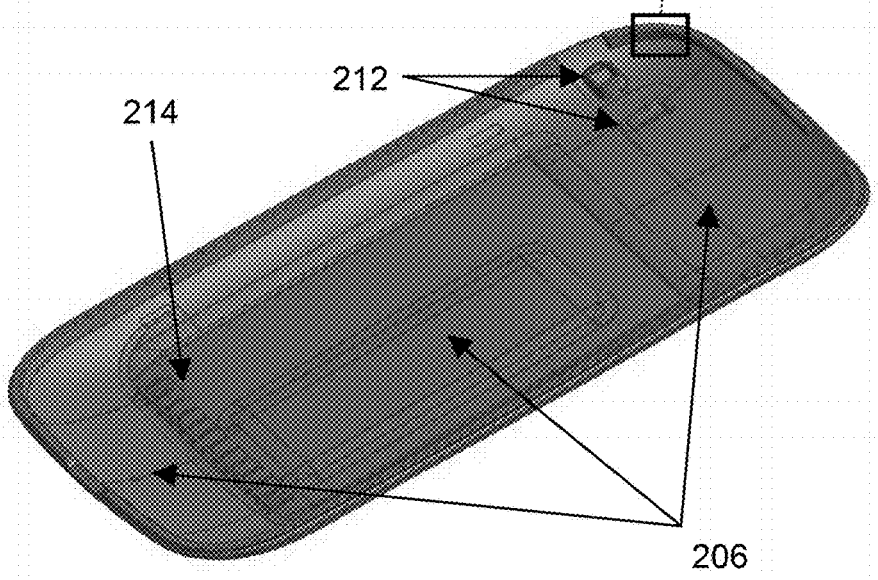
FIG. 2b

ALUMINUM CASTING ALLOYS HAVING MANGANESE, ZINC AND ZIRCONIUM

CROSS-REFERENCE TO RELATED APPLICATION

This patent application claims benefit of priority of U.S. Provisional Patent Application No. 62/042,638, filed Aug. 27, 2014, entitled "IMPROVED ALUMINUM CASTING ALLOYS HAVING MANGANESE, ZINC AND ZIRCONIUM", which is incorporated herein by reference in its entirety.

BACKGROUND

Aluminum casting alloys are useful in a variety of applications. However, improving one property of an aluminum casting alloy without degrading another property is elusive. For example, it is difficult to increase the strength of an alloy without decreasing the ductility of an alloy.

SUMMARY OF THE DISCLOSURE

Broadly, the present patent application relates to improved aluminum casting alloys (also known as foundry alloys), and methods for producing the same. Specifically, the present patent application relates to aluminum casting alloys having manganese (Mn) zinc (Zn), and zirconium (Zr). The new aluminum casting alloys may optionally include one or more of magnesium (Mg), cerium (Ce), and cobalt (Co). Generally, the new aluminum casting alloys achieve an improved combination of properties, such as an improved combination of at least two of castability, strength, elongation and/or appearance (e.g., anodized appearance).

The new aluminum casting alloys generally include manganese, zinc and zirconium. In this regard, the new aluminum casting alloys generally include from 2.0 to 5.0 wt. % Mn, 1.0-4.5 wt. % Zn, and from 0.05 to 0.9 wt. % Zr, the balance being aluminum, optional secondary elements, iron and silicon impurities, and other elements, as described in further detail below. In one embodiment, a new aluminum casting alloy includes at least 2.1 wt. % Mn. In another embodiment, a new aluminum casting alloy includes at least 2.2 wt. % Mn. In yet another embodiment, a new aluminum casting alloy includes at least 2.3 wt. % Mn. In another embodiment, a new aluminum casting alloy includes at least 2.4 wt. % Mn. In one embodiment, a new aluminum casting alloy includes not greater than at least 4.75 wt. % Mn. In another embodiment, a new aluminum casting alloy includes not greater than 4.5 wt. % Mn. In yet another embodiment, a new aluminum casting alloy includes not greater than 4.25 wt. % Mn. In another embodiment, a new aluminum casting alloy includes not greater than 4.0 wt. % Mn. In one embodiment, manganese is the predominate alloying element of the new aluminum casting alloy other than aluminum.

The new aluminum casting alloys include from 1.0 to 4.5 wt. % Zn. In one embodiment, a new aluminum casting alloy includes at least 1.25 wt. % Zn. In another embodiment, a new aluminum casting alloy includes at least 1.50 wt. % Zn. In yet another embodiment, a new aluminum casting alloy includes at least 1.75 wt. % Zn. In another embodiment, a new aluminum casting alloy includes at least 2.0 wt. % Zn. In yet another embodiment, a new aluminum casting alloy includes at least 2.25 wt. % Zn. In another embodiment, a new aluminum casting alloy includes at least 2.50 wt. % Zn. In one embodiment, a new aluminum casting alloy includes not greater than 4.0 wt. % Zn. In another embodiment, a new aluminum casting alloy includes not greater than 3.75 wt. % Zn. In yet another embodiment, a new aluminum casting alloy includes not greater than 3.5 wt. % Zn. In another embodiment, a new aluminum casting alloy includes not greater than 3.25 wt. % Zn. In yet another embodiment, a new aluminum casting alloy includes not greater than 3.0 wt. % Zn. In one embodiment, zinc is the predominate alloying element of the new aluminum casting alloy other than aluminum. In one embodiment, one of zinc and manganese is the predominate alloying element of the new aluminum casting alloy other than aluminum.

The new aluminum casting alloys include from 0.05 to 0.90 wt. % Zr. In one embodiment, a new aluminum casting alloy includes at least 0.10 wt. % Zr. In another embodiment, a new aluminum casting alloy includes at least 0.15 wt. % Zr. In yet another embodiment, a new aluminum casting alloy includes at least 0.20 wt. % Zr. In one embodiment, a new aluminum casting alloy includes not greater than 0.85 wt. % Zr. In another embodiment, a new aluminum casting alloy includes not greater than 0.80 wt. % Zr. In yet another embodiment, a new aluminum casting alloy includes not greater than 0.75 wt. % Zr. In another embodiment, a new aluminum casting alloy includes not greater than 0.70 wt. % Zr.

The new aluminum casting alloy may optionally include up to 1.5 wt. % Mg. In embodiments where magnesium is used, the new aluminum casting alloy includes from 0.25 to 1.5 wt. % Mg. In one embodiment, a new aluminum casting alloy includes at least 0.30 wt. % Mg. In another embodiment, a new aluminum casting alloy includes at least 0.35 wt. % Mg. In yet another embodiment, a new aluminum casting alloy includes at least 0.4 wt. % Mg. In another embodiment, a new aluminum casting alloy includes at least 0.45 wt. % Mg. In yet another embodiment, a new aluminum casting alloy includes at least 0.50 wt. % Mg. In another embodiment, a new aluminum casting alloy includes at least 1.50 wt. % Mg. In one embodiment, a new aluminum casting alloy includes not greater than 1.4 wt. % Mg. In another embodiment, a new aluminum casting alloy includes not greater than 1.3 wt. % Mg. In yet another embodiment, a new aluminum casting alloy includes not greater than 1.2 wt. % Mg. In another embodiment, a new aluminum casting alloy includes not greater than 1.1 wt. % Mg. In yet another embodiment, a new aluminum casting alloy includes not greater than 1.0 wt. % Mg.

In embodiments where magnesium is not used, the new aluminum casting alloy generally includes not greater than 0.24 wt. % Mg. In one embodiment, a new aluminum casting alloy includes not greater than 0.20 wt. % Mg. In another embodiment, a new aluminum casting alloy includes not greater than 0.15 wt. % Mg. In yet another embodiment, a new aluminum casting alloy includes not greater than 0.10 wt. % Mg. In another embodiment, a new aluminum casting alloy includes not greater than 0.05 wt. % Mg. In yet another embodiment, a new aluminum casting alloy includes not greater than 0.03 wt. % Mg. In another embodiment, a new aluminum casting alloy includes not greater than 0.01 wt. % Mg.

The new aluminum casting alloys may optionally include at least one of cerium (Ce) and cobalt (Co), having up to 2.5 wt. % Ce and/or up to 0.75 wt. % Co. In embodiments where cerium is used, the new aluminum casting alloy includes from 0.25 to 2.5 wt. % Ce. In one embodiment, a new aluminum casting alloy includes at least 0.35 wt. % Ce. In another embodiment, a new aluminum casting alloy includes at least 0.50 wt. % Ce. In yet another embodiment, a new aluminum casting alloy includes at least 0.65 wt. % Ce. In another embodiment, a new aluminum casting alloy includes at least 0.8 wt. % Ce. In yet another embodiment, a new aluminum casting alloy includes at least 1.0 wt. % Ce. In one embodiment, a new aluminum casting alloy includes not greater than 2.2 wt. % Ce. In another embodiment, a new aluminum casting alloy includes not greater than 2.0 wt. % Ce.

In embodiments where cobalt is used, the new aluminum casting alloy includes from 0.25 to 0.75 wt. % Co. In one embodiment, a new aluminum casting alloy includes at least 0.30 wt. % Co. In another embodiment, a new aluminum casting alloy includes at least 0.35 wt. % Co. In yet another embodiment, a new aluminum casting alloy includes at least 0.40 wt. % Co. In another embodiment, a new aluminum casting alloy includes at least 0.45 wt. % Co. In yet another embodiment, a new aluminum casting alloy includes at least 0.50 wt. % Co. In one embodiment, a new aluminum casting alloy includes not greater than 0.70 wt. % Co. In another embodiment, a new aluminum casting alloy includes not greater than 0.65 wt. % Co. In yet another embodiment, a new aluminum casting alloy includes not greater than 0.60 wt. % Co. In yet another embodiment, a new aluminum casting alloy includes not greater than 0.55 wt. % Co.

In embodiments where cerium and/or cobalt is/are not used, the new aluminum casting alloy generally includes not greater than 0.24 wt. % each of Ce and/or Co. In one embodiment, a new aluminum casting alloy includes not greater than 0.20 wt. % each of Ce and/or Co. In another embodiment, a new aluminum casting alloy includes not greater than 0.15 wt. % each of Ce and/or Co. In yet another embodiment, a new aluminum casting alloy includes not greater than 0.10 wt. % each of Ce and/or Co. In another embodiment, a new aluminum casting alloy includes not greater than 0.05 wt. % each of Ce and/or Co. In yet another embodiment, a new aluminum casting alloy includes not greater than 0.03 wt. % each of Ce and/or Co. In another embodiment, a new aluminum casting alloy includes not greater than 0.01 wt. % each of Ce and/or Co.

The new aluminum casting alloys generally include low amounts of copper (Cu), generally having not greater than 0.40 wt. % Cu. In one embodiment, a new aluminum casting alloy includes not greater than 0.25 wt. % Cu. In another embodiment, a new aluminum casting alloy includes not greater than 0.20 wt. % Cu. In yet another embodiment, a new aluminum casting alloy includes not greater than 0.15 wt. % Cu. In another embodiment, a new aluminum casting alloy includes not greater than 0.10 wt. % Cu. In yet another embodiment, a new aluminum casting alloy includes not greater than 0.05 wt. % Cu. In another embodiment, a new aluminum casting alloy includes not greater than 0.03 wt. % Cu. In yet another embodiment, a new aluminum casting alloy includes not greater than 0.01 wt. % Cu.

As noted above, the balance of the new aluminum casting alloys is generally aluminum, optional secondary elements and impurities. The optional secondary elements may be additives that facilitate casting and/or the appropriate grain structure of the final shape cast aluminum alloy product, among other properties. In this regard, the new aluminum casting alloy may include one or more of titanium (Ti), chromium (Cr), nickel (Ni), strontium (Sr), and the like.

Regarding titanium, the new aluminum casting alloy may include up to 0.25 wt. % Ti. For example, a new aluminum casting alloy includes 0.01 to 0.25 wt. % Ti. In one embodiment, a new aluminum casting alloy includes at least 0.02 wt. % Ti. In another embodiment, a new aluminum casting alloy includes at least 0.03 wt. % Ti. In yet another embodiment, a new aluminum casting alloy includes at least 0.04 wt. % Ti. In another embodiment, a new aluminum casting alloy includes at least 0.05 wt. % Ti. In yet another embodiment, a new aluminum casting alloy includes at least 0.06 wt. % Ti. In one embodiment, a new aluminum casting alloy includes not greater than 0.20 wt. % Ti. In another embodiment, a new aluminum casting alloy includes not greater than 0.18 wt. % Ti. In yet another embodiment, a new aluminum casting alloy includes not greater than 0.15 wt. % Ti. In another embodiment, a new aluminum casting alloy includes not greater than 0.12 wt. % Ti. In yet another embodiment, a new aluminum casting alloy includes not greater than 0.10 wt. % Ti. At least some of the titanium may be present in the form of $TiB_2$ and/or TiC as a grain refiner. In one embodiment, the silicon-based aluminum alloy includes 0.001 to 0.03 wt. % boron. In one embodiment, the silicon-based aluminum alloy includes 0.001 to 0.03 wt. % carbon. In embodiments where titanium is not used, the new aluminum casting alloy includes less than 0.01 wt. % Ti.

Regarding nickel, the new aluminum casting alloy may include up to 0.25 wt. % Ni. For example, a new aluminum casting alloy may include 0.05 to 0.25 wt. % Ni. In one embodiment, a new aluminum casting alloy includes not greater than 0.15 wt. % Ni. In another embodiment, a new aluminum casting alloy includes not greater than 0.10 wt. % Ni. In embodiments where nickel is not used, the new aluminum casting alloy includes less than 0.05 wt. % Ni.

Regarding chromium, the new aluminum casting alloy may include up to 0.25 wt. % Cr. For example, a new aluminum casting alloy may include 0.05 to 0.25 wt. % Cr. In one embodiment, a new aluminum casting alloy includes not greater than 0.15 wt. % Cr. In another embodiment, a new aluminum casting alloy includes not greater than 0.10 wt. % Cr. In embodiments where chromium is not used, the new aluminum casting alloy includes less than 0.05 wt. % Cr.

Regarding strontium, the new aluminum casting alloy may include up to 0.15 wt. % Sr. For example, a new aluminum casting alloy may include 0.008 to 0.15 wt. % Sr. In one embodiment, a new aluminum casting alloy includes not greater than 0.10 wt. % Sr. In embodiments where strontium is not used, the new aluminum casting alloy includes less than 0.008 wt. % Sr.

Regarding impurities, the new aluminum casting alloy generally includes iron and silicon, among other elements, described below, as impurities. In this regard, the new aluminum casting alloy generally includes not greater than 0.80 wt. % Fe and not greater than 0.50 wt. % Si. In one embodiment, a new aluminum casting alloy includes not greater than 0.50 wt. % Fe. In another embodiment, a new aluminum casting alloy includes not greater than 0.35 wt. % Fe. In yet another embodiment, a new aluminum casting alloy includes not greater than 0.25 wt. % Fe. In another embodiment, a new aluminum casting alloy includes not greater than 0.20 wt. % Fe. In yet another embodiment, a new aluminum casting alloy includes not greater than 0.15 wt. % Fe. In another embodiment, a new aluminum casting alloy includes not greater than 0.10 wt. % Fe. Due to its presence in primary aluminum, a new aluminum casting alloy generally includes at least 0.01 wt. % Fe. In one embodiment, a new aluminum casting alloy includes not greater than 0.35 wt. % Si. In another embodiment, a new aluminum casting alloy includes not greater than 0.25 wt. % Si. In yet another embodiment, a new aluminum casting alloy includes not greater than 0.20 wt. % Si. In another embodiment, a new aluminum casting alloy includes not greater than 0.15 wt. % Si. In yet another embodiment, a new aluminum casting alloy includes not greater than 0.10 wt. % Si. In another embodiment, a new aluminum casting alloy includes not greater than 0.05 wt. % Si. Due to its presence in primary aluminum, a new aluminum casting alloy generally includes at least 0.01 wt. % Si.

The new aluminum casting alloys generally include not greater than 0.15 wt. % each of other elements (i.e., elements of the periodic table other than those described above (i.e., other than Al, Mn, Zn, Zr, Mg, Co, Ce, Cu, Ti, Ni, Cr, Sr, Fe, Si),) and not greater than 0.50 wt. % in total of these other elements. In one embodiment, a new aluminum casting alloy includes not greater than 0.10 wt. % each of other elements, and not greater than 0.35 wt. % in total of these other elements. In another embodiment, a new aluminum casting alloy includes not greater than 0.05 wt. % each of other elements, and not greater than 0.15 wt. % in total of these other elements. In yet another embodiment, a new aluminum casting alloy includes not greater than 0.03 wt. % each of other elements, and not greater than 0.10 wt. % in total of these other elements.

Combination of Elements

As shown by the below examples, the new aluminum casting alloys include manganese, zinc and zirconium, optionally with one or more of magnesium, cobalt, and cerium. In one embodiment, manganese is the predominate alloying element of the new aluminum casting alloy, other than aluminum. In another embodiment, at least one of manganese and zinc is the predominate alloying element of the new aluminum casting alloy, other than aluminum.

In one approach, a new aluminum casting alloy is an Al—Mn—Ce—Zn—Zr alloy, having manganese as the predominate alloying element, other than aluminum, and with cerium, zinc, and zirconium being used. Any of the above-described amounts and ranges of manganese, cerium, zinc and zirconium may be used. In one embodiment, the amount of cerium exceeds the amount of zinc in the new Al—Mn—Ce—Zn—Zr casting alloy. In another embodiment, the amount of zinc exceeds the amount of cerium in the new Al—Mn—Ce—Zn—Zr casting alloy. In one embodiment, a new Al—Mn—Ce—Zn—Zr casting alloy includes from 1.9-2.9 wt. % Mn, 1.5-2.5 wt. % Ce, 0.9-1.9 wt. % Zn, and 0.1-0.5 wt. % Zr. In another embodiment, a new Al—Mn—Ce—Zn—Zr casting alloy includes from 2.1-2.7 wt. % Mn, 1.7-2.3 wt. % Ce, 1.1-1.7 wt. % Zn, and 0.1-0.4 wt. % Zr. In yet another embodiment, a new Al—Mn—Ce—Zn—Zr casting alloy includes from 2.2-2.6 wt. % Mn, 1.8-2.0 wt. % Ce, 1.2-1.6 wt. % Zn, and 0.1-0.3 wt. % Zr. In all of these embodiments, the new Al—Mn—Ce—Zn—Zr casting alloy generally includes not greater than 0.40 wt. % Cu, such as any of the copper amounts described above. The balance of the new Al—Mn—Zn—Ce—Co—Zr casting alloy is generally aluminum, optional secondary elements, iron and silicon impurities, and other elements, as described above.

In another approach, a new aluminum casting alloy is an Al—Mn—Zn—Ce—Co—Zr alloy, having manganese as the predominate alloying element, other than aluminum, and with zinc, cerium, cobalt and zirconium being used, such as in any of the amounts described above. Any of the above-described amounts and ranges of manganese, zinc, cerium, cobalt and zirconium may be used. In one embodiment, the amount of zinc exceeds the amount one of cerium in the new Al—Mn—Zn—Ce—Co—Zr casting alloy. In another embodiment, the amount of cerium exceeds the amount of zinc in the new Al—Mn—Zn—Ce—Co—Zr casting alloy. In one embodiment, a new Al—Mn—Zn—Ce—Co—Zr casting alloy includes from 1.9-2.9 wt. % Mn, 0.9-1.9 wt. % Zn, 0.5-1.5 wt. % Ce, 0.25-0.75 wt. % Co, and 0.1-0.5 wt. % Zr. In another embodiment, a new Al—Mn—Zn—Ce—Co—Zr casting alloy includes from 2.1-2.7 wt. % Mn, 1.1-1.7 wt. % Zn, 0.65-1.35 wt. % Ce, 0.35-0.65 wt. % Co, and 0.1-0.4 wt. % Zr. In yet another embodiment, a new Al—Mn—Zn—Ce—Co—Zr casting alloy includes from 2.2-2.6 wt. % Mn, 1.2-1.6 wt. % Zn, 0.8-1.2 wt. % Ce, 0.4-0.6 wt. % Co, and 0.1-0.3 wt. % Zr. In all of these embodiments, the new Al—Mn—Zn—Ce—Co—Zr casting alloy generally includes not greater than 0.40 wt. % Cu, such as any of the copper amounts described above. The balance of the new Al—Mn—Zn—Ce—Co—Zr casting alloy is generally aluminum, optional secondary elements, iron and silicon impurities, and other elements, as described above.

In yet another approach, a new aluminum casting alloy is an Al—Mn—Zn—Zr alloy, having manganese as the predominate alloying element, other than aluminum, and with zinc and zirconium being used. Any of the above-described amounts and ranges of manganese, zinc and zirconium may be used. In one embodiment, a new Al—Mn—Zn—Zr casting alloy includes from 2.5-3.5 wt. % Mn, 2.0-3.0 wt. % Zn, and 0.1-0.5 wt. % Zr. In another embodiment, a new Al—Mn—Zn—Zr casting alloy includes from 2.7-3.3 wt. % Mn, 2.2-2.8 wt. % Zn, and 0.1-0.4 wt. % Zr. In yet another embodiment, a new Al—Mn—Zn—Zr casting alloy includes from 2.8-3.2 wt. % Mn, 2.3-2.7 wt. % Zn, and 0.1-0.3 wt. % Zr. In all of these embodiments, the new Al—Mn—Zn—Zr casting alloy generally includes not greater than 0.40 wt. % Cu, such as any of the copper amounts described above. The balance of the new Al—Mn—Zn—Zr casting alloy is generally aluminum, optional secondary elements, iron and silicon impurities, and other elements, as described above.

In yet another approach, a new aluminum casting alloy is an Al—Mn—Zn—Zr alloy, having zinc as the predominate alloying element, other than aluminum, and with manganese and zirconium being used. Any of the above-described amounts and ranges of manganese, zinc and zirconium may be used. In one embodiment, a new Al—Mn—Zn—Zr casting alloy includes from 1.9-2.9 wt. % Mn, 3.5-4.5 wt. % Zn, and 0.1-0.7 wt. % Zr. In another embodiment, a new Al—Mn—Zn—Zr casting alloy includes from 2.1-2.7 wt. % Mn, 3.7-4.3 wt. % Zn, and 0.2-0.6 wt. % Zr. In yet another embodiment, a new Al—Mn—Zn—Zr casting alloy includes from 2.2-2.6 wt. % Mn, 3.8-4.2 wt. % Zn, and 0.3-0.5 wt. % Zr. In all of these embodiments, the new Al—Mn—Zn—Zr casting alloy generally includes not greater than 0.40 wt. % Cu, such as any of the copper amounts described above. The balance of the new Al—Mn—Zn—Zr casting alloy is generally aluminum, optional secondary elements, iron and silicon impurities, and other elements, as described above.

In yet another approach, a new aluminum casting alloy is an Al—Mn—Zn—Mg—Zr alloy, having manganese as the predominate alloying element, other than aluminum, and with zinc, magnesium and zirconium being used. Any of the above-described amounts and ranges of manganese, zinc, magnesium, and zirconium may be used. In one embodiment associated with this approach, a new Al—Mn—Zn—Mg—Zr casting alloy includes from 1.9-2.9 wt. % Mn, 0.9-1.9 wt. % Zn, 0.5-1.5 wt. % Mg, with the amount of zinc exceeding the amount of magnesium, and 0.1-0.7 wt. % Zr, with the amount of magnesium exceeding the amount of zirconium. In another embodiment, a new Al—Mn—Zn—Mg—Zr casting alloy includes from 2.1-2.7 wt. % Mn, 1.1-1.7 wt. % Zn, 0.7-1.3 wt. % Mg, and 0.2-0.6 wt. % Zr. In another embodiment, a new Al—Mn—Zn—Mg—Zr casting alloy includes from 2.2-2.6 wt. % Mn, 1.2-1.6 wt. % Zn, 0.8-1.2 wt. % Mg, and 0.3-0.5 wt. % Zr. In all of these embodiments, the new Al—Mn—Zn—Mg—Zr casting alloy generally includes not greater than 0.40 wt. % Cu, such as any of the copper amounts described above. The balance of the new Al—Mn—Zn—Mg—Zr casting alloy is generally aluminum, optional secondary elements, iron and silicon impurities, and other elements, as described above.

In yet another approach, a new aluminum casting alloy is an Al—Mn—Zn—Mg—Zr alloy, having at least one of zinc and manganese as the predominate alloying element, other than aluminum, and with magnesium and zirconium being used. In one embodiment, zinc is the predominate alloying element of the new Al—Mn—Zn—Mg—Zr casting alloy. Any of the above-described amounts and ranges of manganese, zinc, magnesium, and zirconium may be used. In one embodiment associated with this approach, a new Al—Mn—Zn—Mg—Zr casting alloy includes from 1.9-2.9 wt. % Mn, 2.5-3.5 wt. % Zn, 0.25-1.0 wt. % Mg, and 0.1-0.5 wt. % Zr, with the amount of magnesium exceeding the amount of zirconium. In another embodiment, a new Al—Mn—Zn—Mg—Zr casting alloy includes from 2.1-2.7 wt. % Mn, 2.7-3.3 wt. % Zn, 0.25-0.75 wt. % Mg, and 0.1-0.4 wt. % Zr. In another embodiment, a new Al—Mn—Zn—Mg—Zr casting alloy includes from 2.2-2.6 wt. % Mn, 2.8-3.2 wt. % Zn, 0.4-0.6 wt. % Mg, and 0.1-0.3 wt. % Zr. In all of these embodiments, the new Al—Mn—Zn—Mg—Zr casting alloy generally includes not greater than 0.40 wt. % Cu, such as any of the copper amounts described above. The balance of the new Al—Mn—Zn—Mg—Zr casting alloy is generally aluminum, optional secondary elements, iron and silicon impurities, and other elements, as described above.

The new aluminum casting alloy may be used in various types of foundry casting processes, such as sand mold casting, investment casting (ceramic shell mold), lost foam casting, permanent mold casting, high pressure die casting, squeeze casting, and semi-solid casting, to name a few.

The new aluminum casting alloys may be used, for example, in thin walled shape cast products.

Shape Cast Products

Shape cast products are those products that achieve their final or near final product form after the aluminum alloy casting process. A shape cast product is in final form if it requires no machining after casting. A shape cast product is in near final form if it requires some machining after casting. By definition, shape cast products excludes wrought products, which generally require hot and/or cold work after casting to achieve their final product form. Shape cast products may be produced via any suitable casting process, such as die casting and permanent mold casting processes, among others, as described in further detail below.

In one embodiment, the shape cast products are "thin walled" shape cast products. In these embodiments, the shape cast products have a nominal wall thickness of not greater than about 1.0 millimeter. In one embodiment, a shape cast product has a nominal wall thickness of not greater than about 0.99 mm. In another embodiment, a shape cast product has a nominal wall thickness of not greater than about 0.95 mm. In other embodiments, the shape cast product has a nominal wall thickness of not greater than about 0.9 mm, or not greater than about 0.85 mm, or not greater than about 0.8 mm, or not greater than about 0.75 mm, or not greater than about 0.7 mm, or not greater than about 0.65 mm, or not greater than about 0.6 mm, or not greater than about 0.55 mm, or not greater than about 0.5 mm, or even less.

The nominal wall thickness of a shape cast product is the predominant thickness of the wall of the shape cast product, not including any decorative or support features such as bosses, ribs, webs or draft applied to allow part release from the die. For example, as illustrated in FIGS. 2*a*-2*c*, a mobile electronic device cover 200 has a body 202 having intended viewing surfaces 204 and internal surfaces 206. Intended viewing surfaces, such as surfaces 204 illustrated in FIGS. 2*a*-2*c*, are surfaces that are intended to be viewed by a consumer during normal use of the product. Internal surfaces 206, such as surfaces 206 illustrated in FIGS. 2*a*-2*c*, are generally not intended to be viewed during normal use of the product. For example, the internal surfaces 206 of the mobile electronic device cover 200 are not normally viewed during normal use of the product (e.g., when using to send text messages and/or when using to converse telephonically), but may be occasionally viewed during non-normal usage, such as when changing the battery. In the illustrated embodiment, the body 202 has a nominal wall thickness (NWT) 208 of not greater than about 1.0 mm (e.g., about 0.7 mm). This nominal wall thickness (NWT) does not include any thickness of the decorative features 210, mounting features 212, or reinforcing ribs 214, among others.

In other embodiments, the shape cast product may have a medium wall thickness. In these embodiments, the shape cast product has a nominal wall thickness of not greater than 2 mm, but at least about 1.01 mm. In one embodiment, the shape cast product has a nominal wall thickness of not greater than about 1.95 mm. In other embodiments, the shape cast product may have a nominal wall thickness of not greater than about 1.9 mm, or not greater than about 1.85 mm, or not greater than about 1.8 mm, or not greater than about 1.75 mm, or not greater than about 1.7 mm, or not greater than about 1.65 mm, or not greater than about 1.6 mm, or not greater than about 1.55 mm, or not greater than about 1.5 mm, or not greater than about 1.5 mm, or not greater than about 1.45 mm, or not greater than about 1.4 mm, or not greater than about 1.35 mm, or not greater than about 1.3 mm, or not greater than about 1.25 mm, or not greater than about 1.2 mm, or not greater than about 1.15 mm, or not greater than about 1.1 mm. In these embodiments, the shape cast product may have a nominal wall thickness of greater than about 1.0 mm.

In yet other embodiments, the shape cast products may have a relatively thick wall thickness. In these embodiment, a shape cast product may have a nominal wall thickness of not greater than about 6 millimeters, but at least about 2.01 mm. In one embodiment, a shape cast product has a nominal wall thickness of not greater than about 5 millimeters. In other embodiments, a shape cast product has a nominal wall thickness of not greater than about 4 millimeters, or not greater than about 3 millimeters. In these embodiments, the shape cast product may have a nominal wall thickness of greater than 2 millimeters.

Decorative Shape Cast Products

After casting, a shape cast product may be finished to produce a decorative shape cast product. Decorative shape cast products are those shape cast products that are subjected to one or more finishing steps, as described in further detail below, and which result in the shape cast products having a predetermined color, gloss, and/or texture, among other features, located on at least a portion of an intended viewing surface of the shape cast product. Often these decorative shape cast products achieve a predetermined color, gloss, and/or texture, among other features, that meets consumer acceptance standards.

The decorative shape cast products may have a predetermined color. A predetermined color means a color that is picked in advanced, such as intended color of the end-use decorative shape cast product. In some embodiments, the predetermined color is different than that of the natural color of the substrate.

The predetermined color of the decorative shape cast products is generally achieved by application of a colorant to an oxide layer of the decorative shape cast products. These colorants generally at least partially occupy the pores of the oxide layer. In one embodiment, after application of the colorant, the pores of the oxide layer may be sealed (e.g., when using dye-type colorants). In one embodiment, there is no need to seal the pores of the oxide layer as the colorant already does so (e.g., when using colorants having a polymer backbone based on Si, such as with the use of polysilazanes and polysiloxanes). In one embodiment, the decorative shape cast products achieve color uniformity on one or more of their intended viewing surfaces. This color uniformity may be due to, for example, the alloy composition, the casting process, and/or the finishing process, which may result in the shape cast product being substantially free of visually appearance surface defects. "Color uniformity" and the like means that the color of the finished shape cast product is substantially the same across the intended viewing surface of the shape cast product. For example, in some embodiments, color uniformity may be facilitated via the ability to produce a uniform oxide layer during anodizing, which may result in the ability to reliably produce a uniform color across an intended viewing surface of a shape cast product. In one embodiment, color uniformity is measured via Delta-E (CIELAB). In one embodiment, the variability of the color of the shape cast product is not greater than +/−5.0 Delta E, as measured via a colorimeter employing CIELAB (e.g., a Color Touch PC, by TECHNIDYNE). In other embodiments, the variability of the color of the shape cast product is not greater than +/−4.5 Delta E, or +/−4.0 Delta E, or +/−3.5 Delta E, or +/−3.0 Delta E, or +/−2.5 Delta E, or +/−2.0 Delta E, or +/−1.5 Delta E, or +/−1.0 Delta E, or +/−0.9 Delta E, or not greater than +/−0.8 Delta E, or not greater than +/−0.7 Delta E, or not greater than +/−0.6 Delta E, or not greater than +/−0.5 Delta E, or not greater than +/−0.4 Delta E, or not greater than +/−0.2 Delta E, or not greater than +/−0.1 Delta E, or not greater than +/−0.05 Delta E, or less, as measured via a colorimeter employing CIELAB (e.g., a Color Touch PC, by TECHNIDYNE).

The decorative shape cast products may have a predetermined gloss. A predetermined gloss is a gloss that is picked in advanced, such as an intended gloss of the end-use product. In some embodiments, the predetermined gloss is different than that of the natural gloss of the substrate. In some embodiments, the predetermined gloss is achieved by application of a colorant having a predetermined gloss. In one embodiment, a shape cast product has gloss uniformity. "Gloss uniformity" means that the gloss of the finished shape cast product is substantially the same across the intended viewing surface of the shape cast product. In one embodiment, gloss uniformity is measured in accordance with ASTM D 523. In one embodiment, the variability of the gloss of the shape cast product is not greater than about +/−20 units (e.g., % gloss units) across the intended viewing surface of the shape cast product. In other embodiments, the variability of the gloss is not more than about +/−15 units, or not more than about +/−13 units, or not more than about +/−10 units, or not more than about +/−9 units, or not more than about +/−8 units, or not more than about +/−7 units, or not more than about +/−6 units, or not more than about +/−5 units, or not more than about +/−4 units, or not more than about +/−3 units, or not more than about +/−2 units, or not more than about +/−1 unit across the intended viewing surface of the shape cast product. One instrument for measuring gloss is a BYK-GARDNER AG-4430 micro-TR1-gloss glossmeter.

The color uniformity and/or gloss uniformity of the decorative shape cast products may be due to the relatively uniform oxide layer that is formed during anodization of the shape cast product. A uniform oxide layers may be facilitated via the use of the new aluminum casting alloys described herein. These uniform oxide layers may facilitate a uniform absorption of colorant, and therefore promote color and/or gloss uniformity in the decorative shape cast products.

The decorative shape cast products may have a tailored texture. A tailored texture is texture with predefined shape(s) and/or orientation that is created via chemical, mechanical and/or other processes (e.g., lasers etching, embossing, engraving, and lithographic techniques). In one embodiment, a tailored texture may be created after casting, such as via tailored mechanical processes, such as machining, brushing, blasting and the like. In another embodiment, a tailored texture may be created during casting, such as via the use of predefined patterns within the casting die. In other embodiments, the decorative shape cast products may have a generally smooth surface, i.e., a non-texturized outer surface.

In some embodiments, a shape cast product may have at least two intended view surfaces, one with a first color, gloss, and/or texture, and a second with a second color, gloss and/or texture, different than at least one of the first.

In some embodiments, the decorative shape cast product is substantially free of visually apparent surface defects. "Substantially free of visually apparent surface defects" means that the intended viewing surfaces of the decorative shape cast product are substantially free of surface defects as viewed by human eyesight, with 20/20 vision, when the decorative shape cast product is located at least 18 inches away from the eyes of the human viewing the decorative shape cast product. Examples of visually apparent surface defects include those cosmetic defects that can be viewed due to the casting process (e.g., cold-shuts, lap-lines, flow-lines and mottled discolorations, voids) and/or the alloy microstructure (e.g., the presence of randomly located alpha aluminum phase at or near the intended viewing surface of the decorative shape cast product), among others. Since the finishing process generally allows an appreciable amount of visible light to penetrate tens or hundreds or microns of the decorative shape cast product, which may be reflected and/or absorbed, it may be useful to produce a uniform microstructure and/or restrict or eliminate randomly distributed intermetallics and/or alpha aluminum phase, resulting in a decorative shape cast product that is substantially free of visually apparent surface defects, and which may be accepted by consumers. The presence of visually apparent surface defects is generally determined after anodizing, such as after application of the colorant to the shape cast product.

Shape Cast Product Applications

The decorative shape cast products of the instant disclosure may be utilized in a variety of applications. In one embodiment, the shape cast product is a consumer electronic part. Consumer electronic parts are generally used to enhance the appearance, durability and/or portability of the consumer electronic product, and may be used as at least part of a facade of the consumer electronic part. Example of consumer electronic parts useful with the instant disclosure include outer pieces (e.g., facades, such as faces and covers) or inner pieces for mobile phones, portable and non-portable audio and/or video devices (e.g., iPods or iPhones or portable similar audio/video devices, such as MP3 players), cameras, video cameras, computers (e.g., laptops, desktops), personal digital assistants, televisions, displays (e.g., LCD, plasma), household appliances (e.g., microwaves, cookware, washers, dryers), video playback and recording devices (e.g., DVD players, digital video recorders), other handheld devices (e.g., calculators, GPS devices) and the like. In other embodiments, the decorative shape cast product is a product for other industries, such as products for any of the medical device, sporting goods, automotive or aerospace industries, among others.

These and other aspects, advantages, and novel features of this new technology are set forth in part in the description that follows and will become apparent to those skilled in the art upon examination of the following description and figures, or may be learned by practicing one or more embodiments of the technology provided for by the patent application.

BRIEF DESCRIPTION OF THE DRAWINGS

FIGS. 1*a*-1*c* are graphs plotting strength v. elongation v. anodized appearance for various example 1 alloys.

FIG. 2*a* is a schematic, top-perspective view of one embodiment of a thin walled, shape cast mobile electronic device cover produced from an aluminum alloy.

FIG. 2*b* is a schematic, bottom-perspective view of one embodiment of a thin walled, shape cast mobile electronic device cover produced from an aluminum alloy.

FIG. 2*c* is a close-up view of a portion of the mobile electronic device phone cover of FIG. 2*b*, illustrating its nominal wall thickness.

DETAILED DESCRIPTION

EXAMPLE 1

Several aluminum casting alloys having the compositions (nominal) listed in Table 1, below, are cast via high pressure die casting.

TABLE 1

Nominal composition of Example 1 casting alloys (all values in wt. %)

| Alloy | Mn | Zn | Zr | Other |
|---|---|---|---|---|
| 1 | 2.4 | 1.4 | 0.2 | — |
| 2 | 2.4 | 1.4 | 0.4 | — |
| 3 | 2.4 | 1.4 | 0.2 | 0.5 Mg |
| 4 | 2.4 | 1.4 | 0.2 | 1.0 Mg |
| 5 | 2.4 | 1.4 | 0.2 | 0.5 Mg, 0.3 Cu |
| 6 | 2.4 | 1.4 | 0.2 | 2.0 Ce |
| 7 | 2.4 | 1.4 | 0.2 | 1.0 Ce |
| 8 | 2.4 | 1.4 | 0.2 | 1.0 Ce, 0.5 Co |
| 9 | 2.4 | 1.4 | 0.2 | 1.0 Ce, 1.0 Co |
| 10 | 2.4 | 3.0 | 0.2 | — |
| 11 | 3.0 | 2.5 | 0.2 | — |
| 12 | 2.4 | 3.0 | 0.2 | 0.5 Mg |
| 13 | 2.4 | 1.4 | 0.2 | 0.5 Mg, 1.0 Cu |
| 14 | 2.7 | 1.4 | 0.4 | 1.0 Ce |
| 15 | 4.0 | — | 0.7 | — |
| 16 | 3.0 | — | 0.4 | 3.0 Ce |
| 17 | 3.0 | 1.4 | 0.4 | — |
| 18 | 3.5 | 1.4 | 0.4 | — |
| 19 | 2.4 | 1.4 | 0.4 | 0.5 Mg |
| 20 | 2.4 | 1.4 | 0.4 | 1.0 Mg |
| 21 | 2.4 | 4.0 | 0.4 | — |
| 22 | 3.0 | 2.5 | 0.4 | — |

Unless otherwise indicated, all of these alloys also contained 0.01-0.10 wt. % Ti, less than 0.25 wt. % Si, and less than 0.25 wt. % Fe, the balance being aluminum and impurities (e.g., ≤0.05 wt. % of any other element, and ≤0.15 wt. % total of all other element).

After casting, the alloys were mechanically finished and anodized (Type II anodizing), after which the tensile properties of the alloys were measured, and the anodized appearance was assessed and visually ranked (from AA to D, with AA being excellent and with D being poor). The anodized tensile and anodized appearance results are shown in Table 2, below. In some cases, the as-cast appearance was sufficiently poor that anodizing was not completed, and such alloys were categorized as N/A. As shown, alloys 6, 8, 11, 12, 20, 21 and 22 are invention alloys. All other alloys are non-invention alloys.

TABLE 2

Anodized Tensile and Appearance Properties

| Alloy | UTS | TYS | Elong. | Appearance Rating | Status |
|---|---|---|---|---|---|
| 1 | 150 | 109 | 29 | AA | Non-Invention |
| 2 | 200 | 120 | 19 | AA | Non-Invention |
| 3 | 175 | 118 | 20 | A | Non-Invention |
| 4 | 230 | 142 | 20 | C | Non-Invention |
| 5 | 208 | 134 | 21 | C | Non-Invention |
| 6 | 203 | 131 | 19 | B | Invention |
| 7 | 192 | 126 | 22 | N/A | Non-Invention |
| 8 | 213 | 137 | 18 | B | Invention |
| 9 | 218 | 130 | 4 | C | Non-Invention |
| 10 | 158 | 111 | 23 | A | Non-Invention |
| 11 | 199 | 139 | 19 | A | Invention |
| 12 | 225 | 138 | 23 | B | Invention |
| 13 | 261 | 161 | 20 | D | Non-Invention |
| 14 | 216 | 130 | 20 | N/A | Non-Invention |
| 15 | 220 | 130 | 9 | B | Non-Invention |
| 16 | 223 | 136 | 10 | C | Non-Invention |
| 17 | 181 | 116 | 16 | B | Non-Invention |
| 18 | 188 | 118 | 18 | B | Non-Invention |
| 19 | 186 | 116 | 22 | B | Non-Invention |
| 20 | 228 | 141 | 21 | B | Invention |
| 21 | 213 | 147 | 19 | B | Invention |
| 22 | 186 | 130 | 20 | A | Invention |

As shown in FIGS. 1*a*-1*c*, the invention alloys achieve an improved combination of strength, elongation and anodized appearance, all achieving a tensile yield strength of at least 130 MPa, an elongation of at least 10%, and an anodized appearance ranking of at least "B". For FIGS. 1*a*-1*c* the appearance rating scale is AA=10, A=8, B=6, D=2, and N/A=0. Preferably, an alloy realizes a tensile yield strength of at least 135 MPa, or at least 140 MPa. Preferably, an alloy realizes an elongation of at least 12%, or at least 15%. Preferably, an alloy realizes an appearance rating of at least A.

While various embodiments of the present disclosure have been described in detail, it is apparent that modifications and adaptations of those embodiments will occur to those skilled in the art. However, it is to be expressly understood that such modifications and adaptations are within the spirit and scope of the present disclosure.

What is claimed is:

1. An aluminum alloy consisting of:

1.9-5.0 wt. % Mn;

wherein Mn is the predominate alloying element of the aluminum alloy other than aluminum;

1.75-4.5 wt. % Zn;

up to 1.5 wt. % Mg;

0.05-0.9 wt. % Zr;

0.25 to 2.5 wt. % Ce;
up to 0.75 wt. % Co;
0.01- 0.80 wt. % Fe;
0.01-0.35 wt. % Si;
not greater than 0.40 wt. % Cu;
not greater than 0.25 wt. % Cr;
not greater than 0.25 wt. % Ti;
not greater than 0.15 wt. % Sr;
not greater than 0.25 wt. % Ni; and
the balance being aluminum and other elements, wherein the new aluminum alloy includes not greater than 0.15 wt. % each of the other elements, and wherein the new aluminum alloy includes not greater than 0.50 wt. % in total of the other elements.

2. The aluminum alloy of claim 1, wherein the aluminum alloy includes at least 2.2 wt. % Mn.

3. The aluminum alloy of claim 1, wherein the aluminum alloy includes at least 2.5 wt. % Zn.

4. The aluminum alloy of claim 3, wherein the aluminum alloy includes not greater than 3.5 wt. % Zn.

5. The aluminum alloy of claim 1, wherein the aluminum alloy includes at least 0.15 wt. % Zr.

6. The aluminum alloy of claim 1, wherein the aluminum alloy includes at least 0.25 wt. % Mg.

7. An aluminum alloy consisting of:
1.9-5.0 wt. % Mn;
wherein Mn is the predominate alloying element of the aluminum alloy other than aluminum;
1.75-4.5 wt. % Zn;
up to 1.5 wt. % Mg;
0.05-0.9 wt. % Zr;
up to 2.5 wt. % Ce;
0.25 to 0.75 wt. % Co;
0.01-0.80 wt. % Fe;
0.01-0.35 wt. % Si;
not greater than 0.40 wt. % Cu;
not greater than 0.25 wt. % Cr;
not greater than 0.25 wt. % Ti;
not greater than 0.15 wt. % Sr;
not greater than 0.25 wt. % Ni; and
the balance being aluminum and other elements, wherein the new aluminum alloy includes not greater than 0.15 wt. % each of the other elements, and wherein the new aluminum alloy includes not greater than 0.50 wt. % in total of the other elements.

8. The aluminum alloy of claim 7, wherein the aluminum alloy includes at least 2.2 wt. % Mn.

9. The aluminum alloy of claim 7, wherein the aluminum alloy includes at least 2.5 wt. % Zn.

10. The aluminum alloy of claim 9, wherein the aluminum alloy includes not greater than 3.5 wt. % Zn.

11. The aluminum alloy of claim 7, wherein the aluminum alloy includes at least 0.15 wt. % Zr.

12. The aluminum alloy of claim 7, wherein the aluminum alloy includes at least 0.25 wt. % Mg.

13. The aluminum alloy of claim 12, wherein the aluminum alloy includes not greater than 1.1 wt. % Mg.

* * * * *